US006033163A

United States Patent [19]

Anderson

[11] Patent Number: 6,033,163

[45] **Date of Patent: *Mar. 7, 2000**

[54] TOOL BIT HOLDER

[76] Inventor: Wayne Anderson, 65 Grove St., Northport, N.Y. 11768

[ * ] Notice: This patent issued on a continued prosecution application filed under 37 CFR 1.53(d), and is subject to the twenty year patent term provisions of 35 U.S.C. 154(a)(2).

[21] Appl. No.: 09/181,445

[22] Filed: Oct. 28, 1998

[51] Int. Cl.[7] ..... B65D 85/20

[52] U.S. Cl. ..... 408/241 R; 206/234; 220/786; 224/240; 224/247; 224/666; 248/231.81

[58] Field of Search ..... 206/379, 234; 408/241 R; 220/784, 786, 788; 224/235, 240, 666, 679, 247, 248; 248/311.2, 231.81, 230.7

[56] References Cited

U.S. PATENT DOCUMENTS

| | | | |
|---|---|---|---|
| 4,619,364 | 10/1986 | Czopor, Jr. | 206/379 |
| 4,863,058 | 9/1989 | Antoni et al. | 220/72 |
| 5,265,785 | 11/1993 | Chudy | 224/252 |
| 5,399,051 | 3/1995 | Aken et al. | 408/226 |
| 5,533,843 | 7/1996 | Chung | 408/241 R |
| 5,813,532 | 9/1998 | Kheradpir et al. | 206/379 |
| 5,829,590 | 11/1998 | Klein | 206/369 |
| 5,842,621 | 12/1998 | Gschwind | 224/682 |

*Primary Examiner*—Daniel W. Howell
*Attorney, Agent, or Firm*—Lackenbach Siegel Murzullo Aronson & Greenspan, PC

[57] ABSTRACT

A cylindrical tool bit holder has a rotatably operable cylindrical cover for access to clip mounted tool chuck and tool bits disposed on the inside of the cover, and an integral clip affixed to the holder body for tool belt mounting of the holder, whereby the user with the holder belt mounted, rotatably removes the cover and inspects the array of tool bits and then in turn with the other hand removes the chuck for assembly to the hand tool or then removes a tool bit for assembly to the chuck. After removal of the chuck and tool bit, the cover is rotatably replaced on the cylindrical body of the holder and rotated no more than 120° for locking engagement of the cover on the body. The cover is formed with equally spaced flexible tabs each having respective buttons for slidably engaging into holes on the body, for locking and unlocking the cover to the body. The cover is removed and replaced with the user using only one hand.

15 Claims, 2 Drawing Sheets

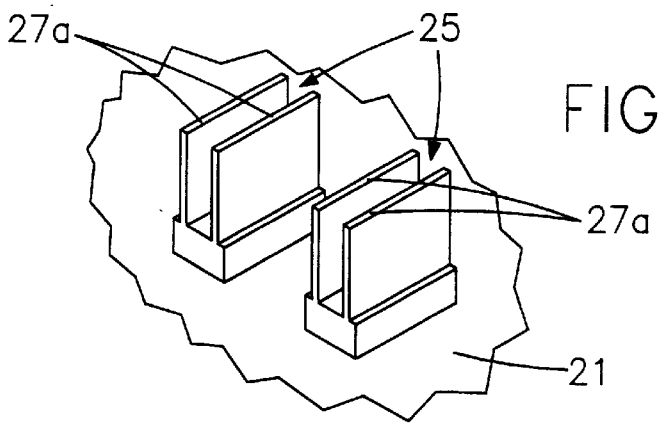
FIG.7
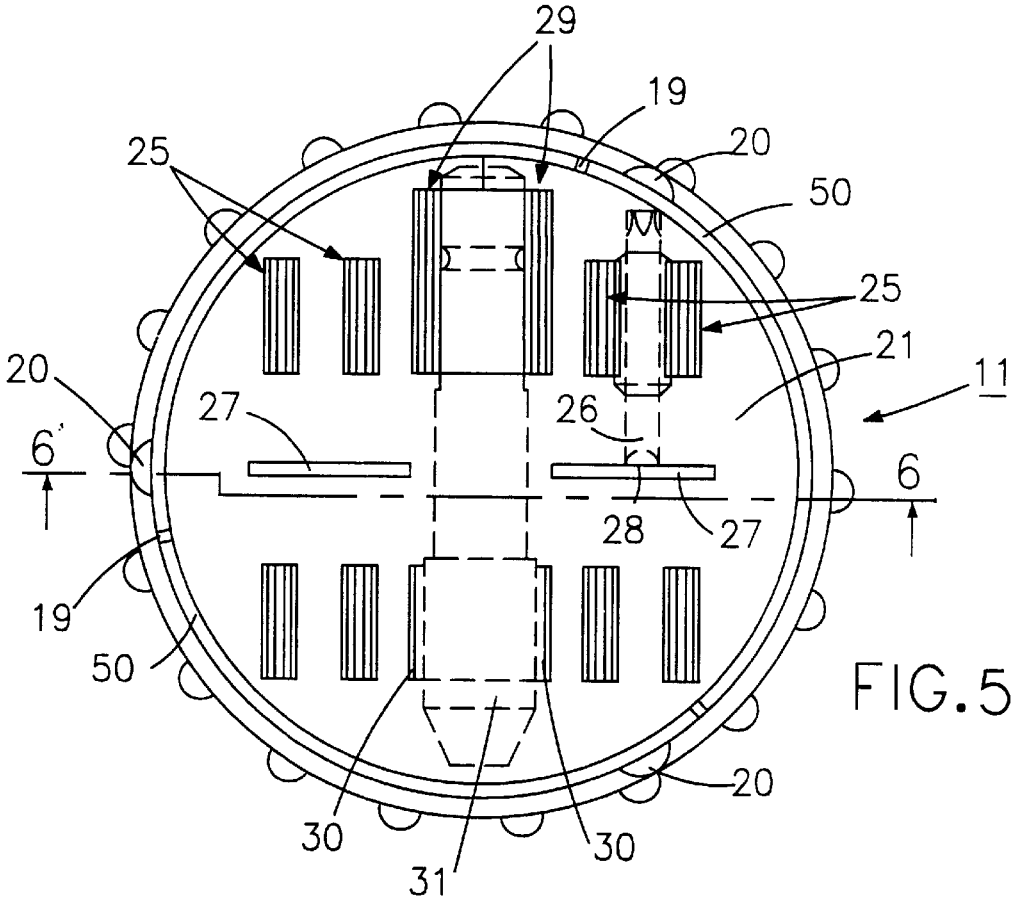
FIG.5
FIG.6
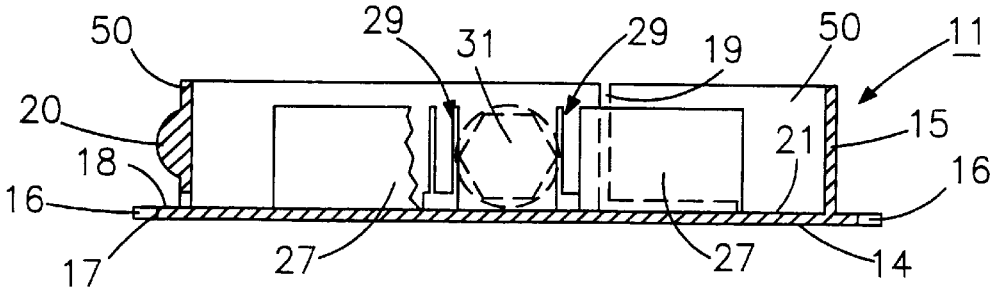

TOOL BIT HOLDER

FIELD OF THE INVENTION

This invention relates to holders for tool elements such as tool bits and a chuck for the tool bits.

BACKGROUND OF THE INVENTION

An electric hand tool such as a drill requires ready access to the drill chuck as well as to the tool bits. This need was particularly acute where the user was working in a limited access area and particularly so where the tool bits and chuck were not immediately accessible. Heretofore tool bits were generally boxed, and it was inconvenient if not impractical to keep or mount the box immediately adjacent the work space. That is, the user would have to leave the work space to find the tool bits or the tool bit box in order to replace the tool bit, and then return to the work place. Another prior art approach was to keep the tool bits in the pockets of the user, but this had the disadvantage in that the user was not always mindful which tool bits were in which pocket. The user in retrieving a tool bit from a pocket would not be aware that the wrong tool bit was inadvertently selected until viewing the tool bit after removal.

The art desired a tool bit holder holder which permitted ready access to the tool bits without the user leaving the immediate work space which provided positive identification of the tool bits to be selected, and with minimum use of the user's hands.

SUMMARY OF THE INVENTION

A tool bit holder of novel design and construction in which tool bits are mounted within the holder cover permits the holder using one hand to gain direct access to the array of tool bits, which on viewing the array, the user removes the desired tool bit and replaces the holder cover in a positive locking manner using one hand. In a more specific aspect, the invention is a tool bit holder with a body and a removable cover, with the inside of the holder cover being formed with pluralities of clip elements for retaining a tool chuck and tool bits, and the holder body being formed with a spring clip for releasably attaching the tool bit holder to the belt of the user. The user, with the holder attached to his belt, with one hand rotatably unlocks and removes the cover and inspects the array of tool bits mounted on the inside of the cover, and then removes the selected tool bit for use with the hand tool, and replaces the cover on the body with a positive rotational locking action using only one hand.

The cover and body are rotatably slidably interengaging cylindrical members, with the body having a cylindrical side formed with three equally spaced radially disposed holes and the cover cylindrical side being formed with three equally spaced partially spherical detents or buttons with adjacent L-shaped grooves providing flexible tabs for flexure of the buttons for slidably engaging and disengaging the holes. The user thereby locks and unlocks the cover from the body using one hand in a respective directional and counterdirectional rotation of less than 120°.

BRIEF DESCRIPTION OF THE DRAWINGS

FIG. 5 is an enlarged front plan view of the tool bit holder of FIG. 1 with the cover removed;

FIG. 6 is a partial fragementary sectional view taken along line 6—6 of FIG. 5; and FIG. 7 is a partial fragmentary perspective view of one of the tool bit holders as shown in FIG. 5.

DESCRIPTION OF THE INVENTION

Figure 1:
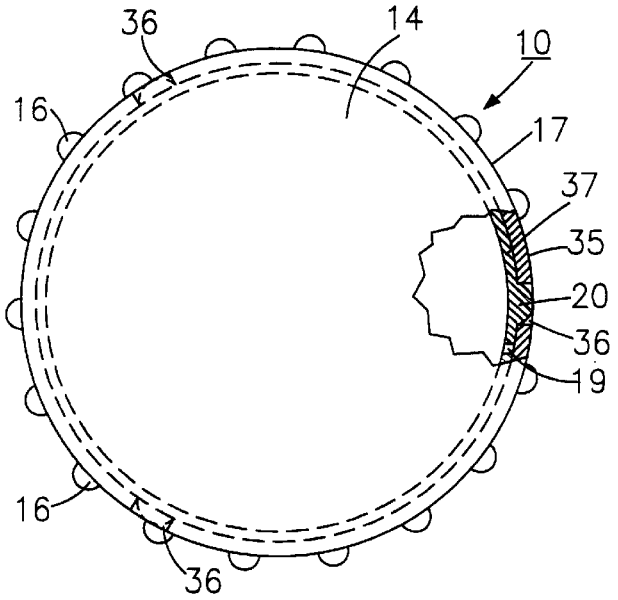
FIG. 1 is a front plan view of the tool bit holder of the present invention.
Figure 2:
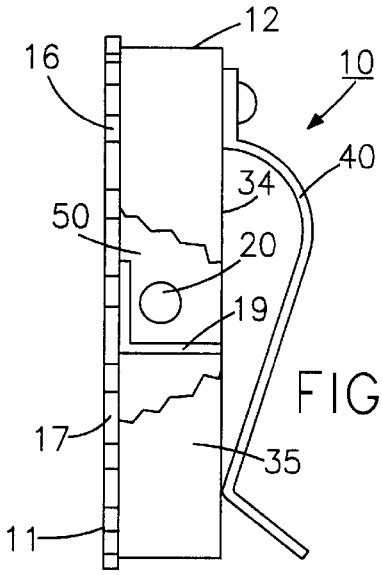
FIG. 2 is a partial fragmentary side elevational view of the tool bit holder of FIG. 1.
Figure 3:
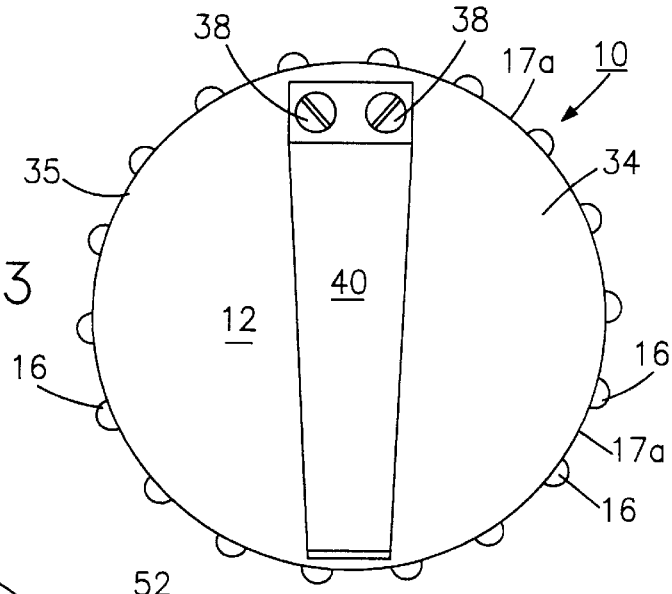
FIG. 3 is a back plan view of the tool bit holder of FIG. 1.

Referring to the Figs., there is shown the tool bit holder 10. Holder 10 comprises, in general terms, cover 11, body 12 and spring belt clip 40. Cover 11 is formed of a circular outer face 14, a cylindrical side 15 integral with face 14, and a plurality of radially spaced ridges 16 formed on the periphery of face edge 17 forming finger grasp recesses 17*a*. Cylindrical side 15 is radially inwardly disposed from edge 17 so as to form face inner lip 18. Side 15 is formed with three equally spaced L-shaped grooves 19 (FIGS. 5 and 6) in turn forming three flexible tabs 50, with three integral partially spherical detents or buttons 20 formed on each tab 50, for reasons hereinafter appearing. Side 15 has an inside cylindrical surface 37.

Referring to FIGS. 5–7, there is shown the inner surface 21 of cover 11. A first plurality of four sets of spaced clips 25 are integrally formed or molded on and with surface 21 for holding tool bits 26 (typical) or like tool elements. A set of two stops or stop elements 27 are also integrally formed or molded with surface 21. In this manner of construction, tool bit 26 is releasably clipped between clips 25 and held in place by stop 27 as at 28. A set of clips 29 are centrally disposed and aligned with clips 30 also centrally disposed on surface 21 to provide for releasable mounting of drill chuck 31, as best shown in FIG. 6. Clips 25 are also provided with double clip elements 27*a* (FIG. 7) to permit additional clip mountings for other tool elements (not shown).

Body 12 is formed of back 34 and cylindrical peripheral side 35 having three equally radially spaced holes 36. Holes 36 are equally radially disposed and sized to releasably slidably receive buttons 20, for purposes hereinafter appearing. Cover inside cylindrical surface 37 and the outside of body cylindrical side 35 are slidably contactingly engaging (FIG. 1), for purposes hereinafter appearing.

Figure 4:
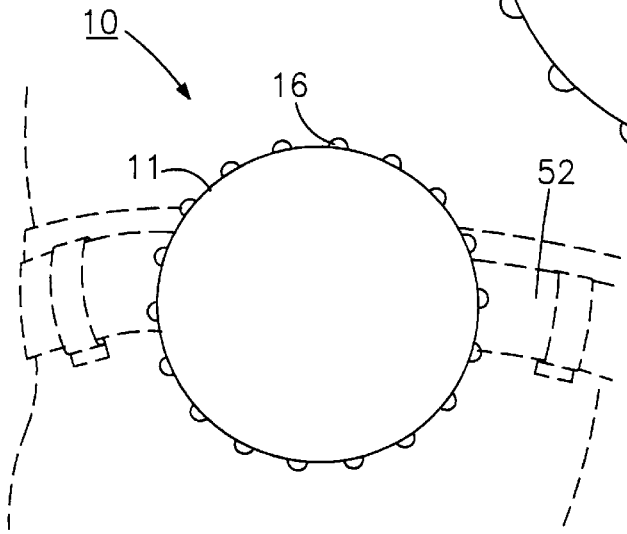
FIG. 4 is a perspective view of the tool bit holder as attached to the belt of the user.

Belt clip 40 is formed of heavy duty plastic construction and is shaped to provide a spring like gripping or holding action to attach the holder 10 to a belt or tool belt 52 (FIG. 4). Clip 40 is permanently affixed to body back 34 by means of two screws 38 or like fastening elements.

In the aforesaid manner of construction, the user attaches or clips the holder 10 to his tool belt 52 by means of clip 40 (FIG. 4), and uses one hand to grab ridges 16 and recesses 17*a* to rotate cover 11 to in turn cause buttons 20 to slidably disengage from holes 30 by and with the flexure of tabs 50, which tab flexure is achieved or permitted by means of L-shaped grooves 19. It is important to note that the user need only rotate the cover substantially less than 120° to disengage and remove the cover 11. The user then inverts the removed cover to view the array of tool bits, and replaces the undesired tool bit and/or removes the desired tool bit by means of clips 25. The user then with his finger engages the ridges 16 and recesses 17*a* and rotatably replaces cover 11on body 12. The user need rotate cover 11 no more than 120° to cause buttons 20 to contactingly slide on body cylindrical inside surface 37 to flex tabs 50 to permit engagement of buttons 20 into holes 36 to lock the cover onto the body, and thereby securely encase the tool bits in the holder.

The cover, body and spring clip may be formed of molded plastic constructing by molding means well known in the art.

While the invention has been described in terms of tool bits and a chuck it is to be understood that the tool holder may be provided with diverse clip means for holding other tool elements and it is not the intention of the invention to limit the same to holding tool bits.

While particular embodiments of the invention have been described, it will be understood and obvious to one skilled in the art that the invention is not so limited, so that obvious modifications and variations can be made, and that such modification and variations are intended to fall within the scope of the appended claims.

What is claimed is:

1. A tool bit holder comprising, body means and cover means for enclosing the body means, said cover means comprising means for releasably holding tool bit means, said cover means and said body means comprising respective cylindrical configuration means for cylindrically rotatably removably, interengaging the cover means with the body means, clip means disposed on the body means for holding the body means to a belt of the user, whereby with the body means enclosed by the cover means the tool bit means is held on the cover means within the enclosed cover means and body means, and with the body means clipped to the user's belt, the cover means is cylindrically rotatably removed from the body means so that the user views the tool bit means in the cover means for selective tool bit means use.

2. A tool bit holder comprising:

a cylindrical cover having an outside and an oppositely disposed inside, and being formed with clips for releasably holding a plurality of tool bits, said clips being disposed on the inside of the cover;

a cylindrical body, and means for rotatably releasably engaging the cover to the body, whereby with the cover engaged on the body the tool bits are retained within the enclosed holder.

3. The tool bit holder of claim 2, said body being formed with a cylindrical body portion being formed with at least one hole, and the cover being formed with a cylindrical flexible portion having a peripherally disposed element, said element being sized for and releasably disposed within the hole, whereby the user to remove the cover rotates the cover causing the cylindrical flexible portion to flex and in turn causing the element to be released from the hole to thereby unlock the cover from the body.

4. The tool bit holder of claim 1 said respective cylindrical configuration means being formed with respective interengaging lock means for releasably locking the cover means to the body means, whereby with directional and counterdirectional cylindrical rotation of the cover means the cover means is releasably locked and unlocked respectively to the body means.

5. The tool bit holder of claim 4, said respective means for locking the cover being disposed 120° of each of the cover means and body means, whereby the cover means is locked and unlocked on the body means in no more than a 120° respective directional and counterdirectional rotation of the cover means.

6. The tool bit holder of claim 1, said cover means being formed with outer surface means and oppositely disposed inner surface means, and said means for releasably holding tool bit means being disposed on said inner surface means.

7. The tool bit holder of claim 6, said means for releasably holding tool bit means comprising clip means integral to and extending from the inner surface means of the removable cover means.

8. The tool bit holder of claim 7, said means for releasably holding tool bit means comprising a first plurality and a second plurality of said clip means, said first plurality being formed for holding tool chuck means and said second plurality being formed for holding said tool bit means.

9. The tool bit holder of claim 1, said cover means and said body means comprising respective opposed rotatably slidingly engaging configuration means and said body means further comprising clip means for attaching the tool bit holder to a belt of the user, whereby with the holder attached to the belt the user with one hand rotatably slidingly disengages the cover means from the body means, and with the other hand removes the tool bit means from the cover means.

10. The tool bit holder of claim 3, comprising three equally spaced holes and three equally spaced elements.

11. The tool bit holder of claim 2, said body further comprising clip means for clipping the holder to a belt of a user, whereby with the holder clipped to the belt, the user with one hand rotatably removes the cover from the body and with the other hand removes a tool bit from the cover.

12. The tool bit holder of claim 2, said cover being formed with means for positively grasping the cover.

13. The tool bit holder of claim 2, said cover and body being formed respectively of one piece plastic constructions.

14. The tool bit holder of claim 3, said element being partially spherical.

15. The tool bit holder of claim 4, said cylindrical rotation of said respective cylindrical configuration means being in a plane with said respective interengaging lock means being disposed in said plane.

* * * * *